US007053596B2

(12) United States Patent
Koyasu

(10) Patent No.: US 7,053,596 B2
(45) Date of Patent: May 30, 2006

(54) CONSTANT VOLTAGE GENERATING CIRCUIT AND REFERENCE VOLTAGE GENERATING CIRCUIT

(75) Inventor: Takahisa Koyasu, Chita (JP)

(73) Assignee: Denso Corporation, Kariya (JP)

( * ) Notice: Subject to any disclaimer, the term of this patent is extended or adjusted under 35 U.S.C. 154(b) by 164 days.

(21) Appl. No.: 10/817,881

(22) Filed: Apr. 6, 2004

(65) Prior Publication Data

US 2004/0245976 A1 Dec. 9, 2004

(30) Foreign Application Priority Data

Jun. 5, 2003 (JP) ..... 2003-160925

(51) Int. Cl.
*G05F 3/20* (2006.01)

(52) U.S. Cl. ..... 323/313; 327/539

(58) Field of Classification Search ..... 323/312–317; 327/539–543

See application file for complete search history.

(56) References Cited

U.S. PATENT DOCUMENTS 4,670,706 A * 6/1987 Tobita ..... 323/313
5,719,522 A 2/1998 Saitou et al.
6,784,724 B1 * 8/2004 Takemura ..... 327/539

FOREIGN PATENT DOCUMENTS

JP A-5-88767 4/1992

* cited by examiner

*Primary Examiner*—Adolf Berhane
(74) *Attorney, Agent, or Firm*—Posz Law Group, PLC

(57) ABSTRACT

In a constant voltage generating circuit and a reference voltage generating circuit, a band-gap circuit operates by using, not a power source voltage, but a constant voltage generated in a constant voltage circuit as a power supply voltage. The constant voltage circuit is equipped with a constant voltage circuit having transistors connected in series and a capacitor, and a transistor is equipped between a constant current circuit and the constant voltage circuit. Furthermore, transistors are added to prevent an early effect of the transistors in the constant current circuit.

7 Claims, 5 Drawing Sheets

CONSTANT VOLTAGE GENERATING CIRCUIT AND REFERENCE VOLTAGE GENERATING CIRCUIT

CROSS REFERENCE TO RELATED APPLICATION

This application is based upon, claims the benefit of priority of, and incorporates by reference the contents of, Japanese Patent Application No. 2003-160925 filed on Jun. 5, 2003.

FIELD OF THE INVENTION

The present invention relates to a constant voltage generating circuit in which a power source voltage is input between an input power supply line and a ground line and also a constant voltage is output between a constant voltage line and the ground line, and a reference voltage generating circuit in which a power source voltage is input between an input power supply line and a ground line and also a band-gap reference voltage is output between a reference voltage line and the ground line.

BACKGROUND OF THE INVENTION

JP-A-5-88767 (Patent Document 1) discloses a band-gap reference circuit designed so that a bias current is supplied from two-stage current-coupled current mirror circuits to a band-gap reference generating circuit. Furthermore, JP-A-6-180616 (Patent Document 2) discloses a band-gap reference voltage generating circuit that includes a constant voltage output portion in which a power supply terminal to be supplied with current is connected to a reference voltage output terminal for reference voltage output and a constant voltage is output to the power supply terminal. The band-gap reference voltage generating circuit also includes a load-variable current supply portion having an emitter follower transistor in which the emitter is connected to the reference voltage output terminal for supplying current thereto, and a base potential controller for negatively feeding back the potential variation of the reference voltage output terminal to the base of the emitter follower transistor.

Enhancement of the vehicle performance by electric control as well as the addition of various functions for providing user convenience have greatly increased the number of electric control units (hereinafter referred to as ECU) mounted in a vehicle. The ECU comprises a microcomputer as a main body and is equipped with a main power source for operation and a power source for backup of RAM. As the scale of the system is larger, the consumption current of the overall ECU when an ignition switch is turned on is increased, and also the operating current (standby current) of the power source for backup, etc. when the ignition switch is turned off is increased. The increase in current consumption causes a decrease in the battery lifetime.

A power source circuit for backup is constructed by a band-gap reference voltage generating circuit, an output voltage detecting circuit, an error amplifying circuit and a constant current circuit, etc. In order to reduce the operating current, it is required to reduce the operating current of not only the band-gap reference voltage generating circuit, but also the other respective circuits.

FIG. 5 shows the electrical circuit construction of a band-gap reference voltage generating circuit disclosed in Patent Document 2. This band-gap reference voltage generating circuit 1 comprises a reference voltage producing circuit 2, an operational amplifier 3 and transistors Q1, Q2. Battery voltage VB is supplied from the terminals 4, 5 of the IC. A band-gap reference voltage VBG is output that has limited temperature dependence on the terminals (or internal nodes) 6, 7 of the IC.

The reference voltage producing circuit 2 includes a series circuit, which includes a resistor R1 and a diode-connected transistor Q3, connected to another series circuit, which includes a resistor R2, a transistor Q4 and a resistor 3 between the terminals 6 and 7. The bases of the transistors Q3 and Q4 are commonly connected to each other, and the voltage (reference voltage) of the common base line is connected to the base of input transistors Q5 of the operational amplifier 3. The collector voltage (reference voltage) of the transistor Q4 is connected to the base of input transistor Q6 of the operational amplifier 3.

The operating current flows through the series circuits of the reference voltage producing circuit 2 at all times. Therefore, in order to reduce the operating current (consumption current) of the band-gap reference voltage generating circuit 1, the resistance values of the resistors R1, R2 and R3 are increased to reduce the operating current. However, when the operating current is reduced, the band-gap reference voltage VBG is liable to vary in accordance with the variation of the battery voltage VB. Therefore, in the conventional construction, it is required to externally equip a capacitor between the terminals 6, 7 rather than increasing the resistance values of the resistors R1, R2, R3. However, the addition of a capacitor causes an increase in substrate area and associated costs.

SUMMARY OF THE INVENTION

The present invention has been implemented in view of the foregoing description, and has an object to provide a reference voltage generating circuit which can reduce operating current and also suppress variation of a band-gap reference voltage due to variation of an input power source voltage.

In order to attain the above object, according to a first aspect of the present invention, a band-gap circuit is operated by using a constant voltage generated on a constant voltage power supply line rather than a variable power source voltage input between an input power supply line and a ground line. The following constituent elements are connected to the base of a first transistor equipped between the input power supply line and the constant voltage power supply line to make the voltage of the constant voltage power supply line constant.

A constant voltage circuit portion comprising plural diodes connected to one another in series is equipped between the base of the first transistor and the ground line, and the base potential of the first transistor is fixed (made constant) Furthermore, a capacitor is connected between the base of the first transistor and the ground line, and voltage variation having a relatively high frequency component such as a surge voltage or the like is suppressed. This capacitor mainly suppresses variation of a band-gap reference voltage at the falling time of an input power source voltage.

Furthermore, a constant current is supplied from a first constant current circuit to the constant voltage circuit, and also a second transistor which operates upon input of a predetermined bias voltage thereto is connected between the first constant current circuit and the constant voltage circuit. The second transistor suppresses the variation of the band-gap reference voltage at the rise-up time of the input power source voltage.

These three means contribute to the voltage-fixing by different actions so as to compensate for one another, and thus the voltage of the constant voltage power supply line can be made constant irrespective of the polarity of the variation of the input power source voltage. As a result, even when the consumption current is reduced by increasing the impedance of the band-gap circuit, the variation of the band-gap reference voltage caused by the variation of the input power source voltage can be suppressed.

According to a second aspect of the present invention, a second constant current circuit supplies the band-gap circuit with a part of current (constant current) needed in the band-gap circuit (particularly, a reference voltage producing circuit described later). In this case, a third transistor which operates upon input of a predetermined bias volt age is connected between the second constant current circuit and the reference voltage line, so that the early effect of the second constant current circuit (transistor) can be prevented and variation of the band-gap reference voltage can be suppressed.

According to a third aspect of the present invention, a third constant current circuit supplies bias current needed in internal circuits (operational amplifier, etc.) of the band-gap circuit from the input power supply line to the band-gap circuit. In this case, a fourth transistor which operates upon input of a predetermined bias voltage thereto is connected between the third constant current circuit and the band-gap circuit so that the early effect of the third constant current circuit (transistor) can be prevented and the variation of the band-gap reference voltage can be suppressed.

According to a fourth aspect of the present invention, the band-gap circuit comprises a reference voltage producing circuit and a differential amplifying circuit. By using the above means, the effect of the variation of the input power source voltage to the band-gap circuit can be suppressed. Therefore, the resistance values of the first to third resistors in the reference voltage producing circuit can be set to high values, and thus the power consumption of the reference voltage generating circuit can be reduced.

According to a fifth aspect of the present invention, the differential amplifying circuit of the band-gap circuit controls the band-gap reference voltage of the reference voltage through a seventh transistor equipped between the constant voltage power supply line and the reference voltage line. By combining this means with the means of the second aspect, the current flowing through the seventh transistor can be reduced by only the amount corresponding to the current supplied from the second constant current circuit. As a result, the seventh transistor can be operated in a relatively small area of the voltage between the base and emitter of the seventh transistor, and stability of the band-gap circuit can be enhanced.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1:
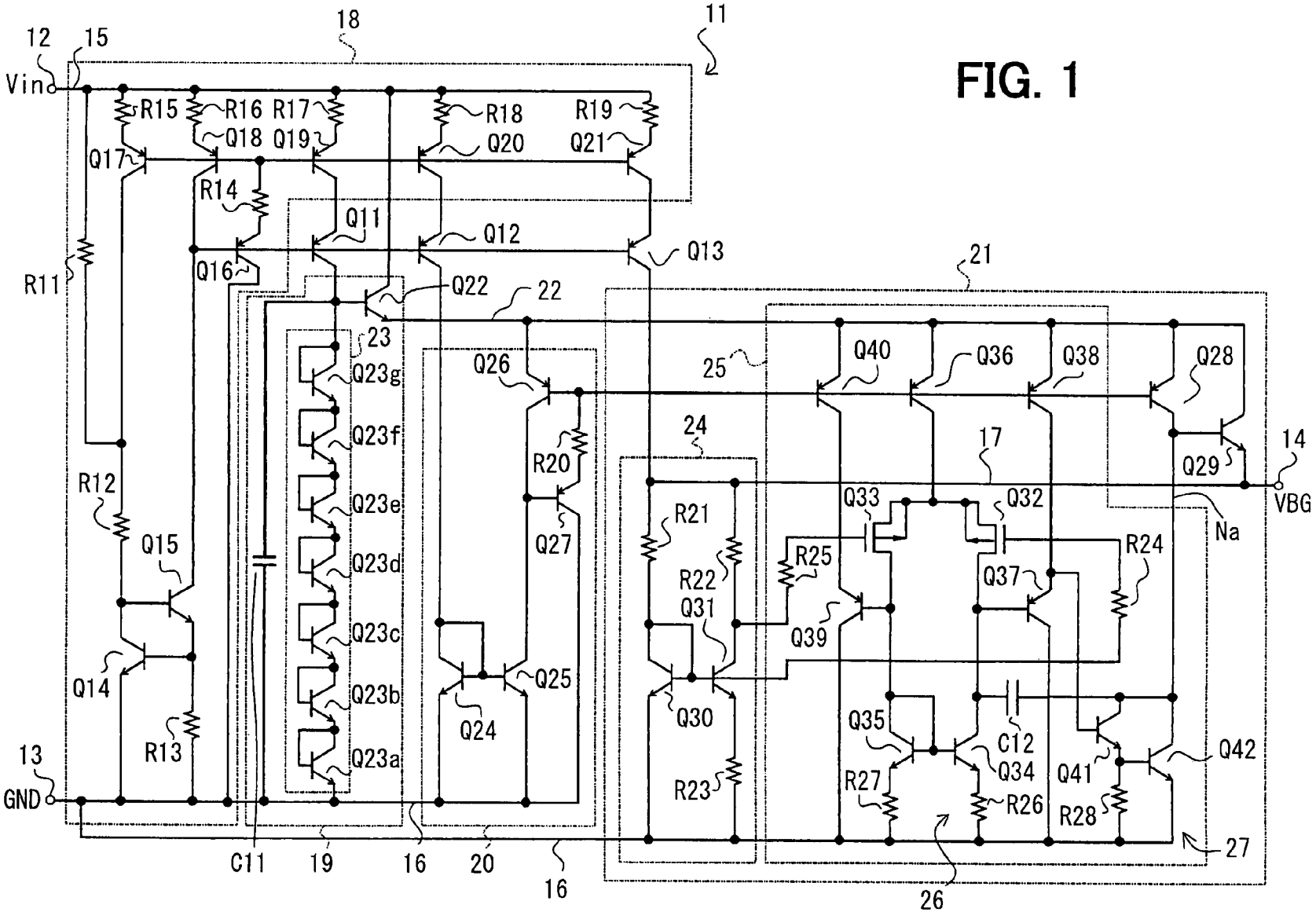
FIG. 1 is an electrical circuit diagram of a reference voltage generating circuit according to a preferred embodiment.

Referring to FIG. 1, the electrical circuit construction of a band-gap reference voltage generating circuit (hereinafter referred to as "reference voltage generating circuit") will be discussed. The reference voltage generating circuit 11 contains digital circuits such as CPU, a memory, etc., various types of analog circuits, a power supply circuit, etc., and also contains an IC for control used in an electric control unit (ECU) mounted in a vehicle, for example.

A power source voltage Vin (a battery voltage VB in this embodiment) is applied from the external to the terminals 12, 13 of the IC, and a band-gap reference voltage VBG (hereinafter referred to merely as "reference voltage VBG ") of 1.22V is output from the terminals 14, 13 of the IC. The reference voltage VBG is extremely small in temperature variation, and supplied to the external and internal circuits of the IC for control. The terminals 12, 13 are connected to the power supply lines 15, 16 (corresponding to the input power supply line, the ground line) in the IC respectively, and the terminal 14 is connected to the reference voltage line 17 in the IC.

The reference voltage generating circuit 11 comprises a constant current circuit 18, a constant voltage circuit 19, a current turn circuit 20, a band-gap circuit 21 and transistors Q11, Q12, Q13. The transistors Q11, Q12, Q13 (corresponding to second, fourth and third transistors) are connected between the constant current circuit 18 and the constant voltage circuit 19, between the constant current circuit 18 and the current turn circuit 20 and between the constant current circuit 18 and the band-gap circuit 21, respectively. The circuit construction of the respective parts will be described in detail.

The constant current circuit 18 is connected between the power supply lines 15 and 16, and it is a self-bias type constant current circuit comprising transistors Q14 to Q21 and resistors R11 to R19. That is, constant current determined on the basis of the voltage VB between the base and emitter of the transistor Q14 and the resistance value of the resistor R13 flows through the resistor R13 connected between the base and emitter of the transistor Q14. This current is supplied as collector current of transistors Q18 and Q17 to the transistor Q14.

The transistors Q17 to Q21 constitute a current mirror circuit in which the bases are commonly connected to one another, and resistors R15 to R19, each of which is connected between each emitter and the power supply line 15, function to reduce noises invading from the terminal 12 into the constant current circuit 18. Here, transistors Q19, Q20, Q21 correspond to the first, third and second constant current circuits, respectively. The emitter of the transistor Q16 is connected to the common base described above through the resistor R14, and the base of the transistor Q16 is connected to the collector of the transistor Q18 and the bases of the transistors Q11, Q12, Q13.

The constant voltage circuit 19 is a circuit for receiving the voltage of the power supply line 15 and outputting a constant voltage Vc of 6·VBE to the power supply line 22 (corresponding to the constant voltage power supply line). The collector and emitter of a transistor Q22 (corresponding to the first transistor) are connected to the power supply line 15 and the power supply line 22 respectively, and the collector of the transistor Q11 is connected to the base of the transistor Q22. Furthermore, a constant voltage circuit portion 23 and a capacitor C11 are connected in parallel between the base of the transistor Q22 and the power supply line 16. The constant voltage circuit portion 23 includes a plurality of diode-connected transistors Q23*a* to Q23*g* connected to one another in series.

The current turn circuit 20 turns the constant current output from the transistor Q12, and supplies bias current to the band-gap circuit 21. The transistors Q24 and Q25 connected to the power supply line 16 constitute a current mirror circuit, the collector of the transistor Q24 is connected to the collector of the transistor Q12, and the collector of the transistor Q25 is connected through the transistor Q26 to the power supply line 22. The base of the transistor Q26 is connected to the bases of the transistors Q36, Q38 and Q40 in the band-gap circuit 21 described later. In order to make the base current flow, a resistor R20 and a transistor Q27 are connected to each other in series between the base of the transistor Q26 and the power supply line 16.

The band-gap circuit 21 comprises a reference voltage producing circuit 24, an operational amplifier 25 (corresponding to the differential amplifying circuit of the invention), and transistors Q28, Q29 connected to the output terminal of the operational amplifier 25.

The reference voltage producing circuit 24 is preferably implemented by a series circuit (corresponding to a first series circuit) comprised of a resistor R21 (corresponding to a first resistor) and a diode-connected NPN type transistor Q30 (corresponding to a fifth transistor) and another series circuit (corresponding to a second series circuit) comprised of a resistor R22 (corresponding to a second resistor), an NPN type transistor Q31 (corresponding to a sixth transistor) and a resistor R23 (corresponding to a third resistor) connected to each other between the reference voltage line 17 and the power supply line 16. Here, the bases of the transistors Q30 and Q31 are connected to each other, and this base potential and the collector potential of the transistor Q31 are set as a first reference voltage and a second reference voltage in this embodiment, respectively. The reference voltage line 17 is connected to the collector of the transistor Q21 through the collector and emitter of the transistor Q13.

The operational amplifier 25 comprises a differential amplifying circuit 26 serving as an input stage and an output circuit 27 serving as an output stage. The input transistor of the differential amplifying circuit 26 comprises MOS transistors Q32, Q33, which may be P-channel type FETs. The bases of the transistors Q30, Q31 and the collector of the transistor Q31 are connected to the gates of the MOS transistors Q32 and Q33 through the resistors R24 and R25, respectively. The drain of the MOS transistor Q32 (Q33) is connected to the power supply line 16 through the transistor Q34 and the resistor R26 (through the transistor Q35 and the resistor R27), and the respective sources thereof are commonly connected to each other, and further connected to the power supply line 22 through a transistor Q36 which is driven with constant current.

A transistor Q37 shifts the level of the output voltage of the differential amplifying circuit 26 and then supplies the output voltage to the output circuit 27. The base and collector of the transistor Q37 are connected to the collector of the transistor Q34 and the power supply line 16 respectively, and the emitter thereof is connected to the power supply line 22 through a transistor Q38 which is driven with constant current. Accordingly, the collector potential of the transistor Q34 is fixed to the same VBE as the collector potential of the transistor Q35. In order to design the differential amplifying circuit 26 in a symmetrical structure, a base current compensating circuit comprising transistors Q39, Q40 is added to the side of the transistors Q33, Q35.

The output circuit 27 is equipped between the differential amplifying circuit 26 and the output terminal (node Na) of the operational amplifier 25. The transistors Q41 and Q42 are Darlington-connected to each other, and a resistor R28 is connected between the base and emitter of the transistor Q42. The common collector of the transistors Q41 and Q42 is connected to the node Na, and also connected to the collector of the transistor Q34 through a capacitor C12 for providing phase compensation. The base of the transistor Q41 is connected to the emitter of the transistor Q37.

The transistors Q28 and Q29 (corresponding to the seventh transistor) are connected between the power supply line 22 and the node Na and between the power supply line 22 and the reference voltage line 17 respectively. Here, the collector of the transistor Q28 and the base of the transistor Q29 are connected to the node Na, and the base of the transistor Q28 is commonly connected to each of the bases of the transistors Q26, Q36, Q38, Q40.

Next, the operation of the reference voltage generating circuit 11 will be described with reference to FIGS. 2A–2E and FIGS. 3A–3D.

The operational amplifier 25 is supplied with the base potential of the transistors Q30, Q31 and the collector potential of the transistor Q31 in the reference voltage producing circuit 24, and controls the voltage (reference voltage VBG) of the reference voltage line 17 so that both the voltages are coincident with each other. Accordingly, the transistors Q30 and Q31 are driven with different current densities, and the differential voltage between the base-emitter voltages of the transistors Q30 and Q31 is applied to the resistor R23.

Assuming that the emitter area of the transistors Q30 and Q31 is equal, the reference voltage VBG generated at the reference voltage line 17 (terminal 14) is represented by the following equation (1), wherein the respective resistance values of the resistors R21, R22, R23 are represented by R21, R22 and R23 and the base-emitter voltage of the transistor Q30 is represented by VBE(Q30):

$$VBG=VBE(Q30)+(R22/R23)\cdot VT\cdot ln(R22/R21) \quad (1)$$

Here, VT=KT/q

That is, the reference voltage VBG corresponds to the weighted addition of a first term having a negative temperature coefficient and a second term having a positive temperature coefficient, and the resistance values R21, R22 and R23 are determined so that the temperature coefficients thereof are equal to zero in design. In order to correct the deviation of the reference voltage VBG due to the dispersion in characteristic and thus achieve a higher-precision reference voltage VBG, laser trimming is carried out on the resistor R22 formed of, for example, chrome silicon in a wafer testing process to adjust the reference voltage VBG to a design value (for example, 1.22V).

In this embodiment, the input transistor of the differential amplifying circuit 26 is implemented by the MOS transistors Q32, Q33, so that the input impedance thereof is extremely high, and the input bias current of the operation amplifier 25 is extremely small. Accordingly, even when the resistance values of the resistors R21, R22, R23 of the reference voltage producing circuit 24 are increased to reduce the current flowing through the transistors Q30, Q31, the input bias current of the differential amplifying circuit 26 is reduced to be sufficiently smaller than the base current of the transistors Q30, Q31, so that the consumption current can be reduced.

However, when the resistance values of the resistors R21, R22, R23 are increased, the band-gap circuit 21 is liable to suffer power source voltage variation. Particularly, the reference voltage generating circuit 11 of this embodiment uses as the power source voltage Vin a battery voltage VB which is liable to vary. Thus, a circuit construction that can sufficiently suppress the voltage variation is needed. Therefore, the reference voltage generating circuit 11 is equipped with plural circuit elements which exhibit a voltage variation suppressing effect synergistically by different actions thereof.

The band-gap circuit 21 operates with, not the power source voltage Vin supplied between the terminals 12, 13, but a constant voltage Vc generated on the power supply line 22. The constant voltage Vc (=6·VBE) is created by the constant voltage circuit portion 23 connected between the base of the transistor Q22 and the power supply line 16. The capacitor C11 connected to the constant voltage circuit portion 23 in parallel suppresses the voltage variation having a relatively high frequency component such as a surge voltage or the like.

Furthermore, the base of the transistor Q11 interposed between the constant current circuit 18 and the constant voltage circuit portion 23 is connected to the base of the transistor Q16 of the constant current circuit 18, and the potential thereof is equal to (Vin−2·VBE) (corresponding to the predetermined voltage). At this time, the potential of the collector of the transistor Q19 is equal to (Vin−VBE), and the amplitude of the voltage between the collect and emitter of the transistor Q19 is fixed to VBE. Accordingly, the early effect of the transistor Q19 is suppressed, and the output current variation of the transistor Q19 due to the variation of the power source voltage Vin (battery voltage VB) can be reduced.

FIGS. 2A to 2E are diagrams showing simulation waveforms of the reference voltage VBE when the constant voltage circuit portion 23, the capacitor C11 and the transistor Q11 described above are added. The power source voltage V in is step wise varied from 6V to 20V at a variation rate of 140V/μs, and then varied from 20V to 6V at a variation rate of −140V/μs.

Figure 2A:
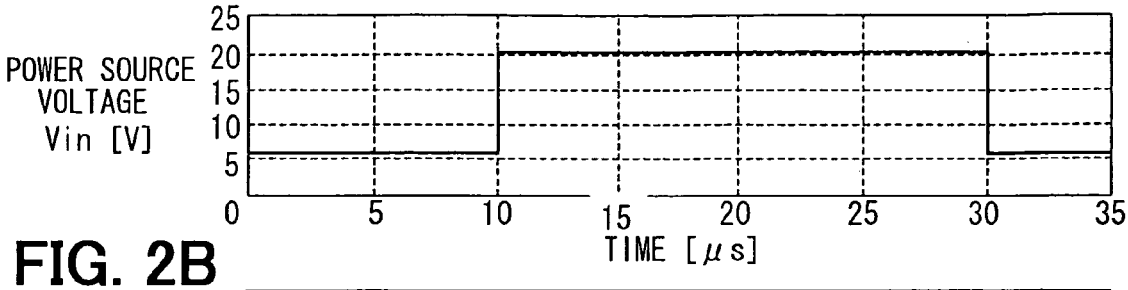
FIGS. 2A–2E are simulated voltage diagrams produced under different conditions.

FIG. 2A shows the power source voltage Vin, and FIGS. 2B to 2E shows the waveforms of the reference voltage VBG under the following conditions. Under any condition, the transistors Q12, Q13 are not added.

Figure 2B:
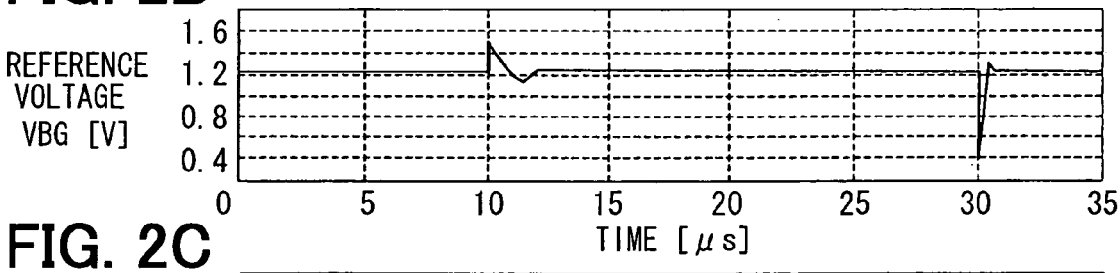
Figure 2C:
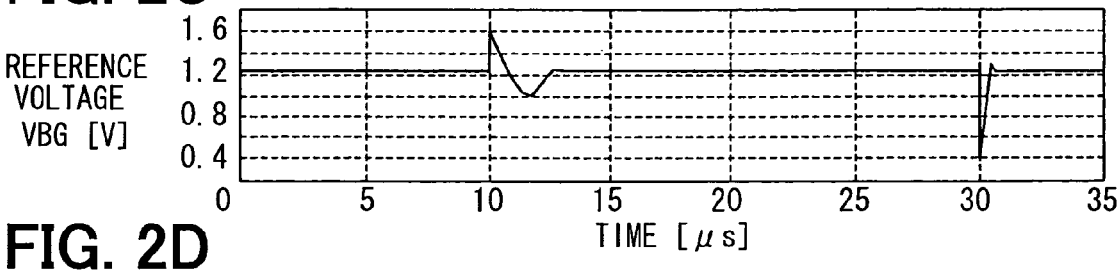
Figure 2D:
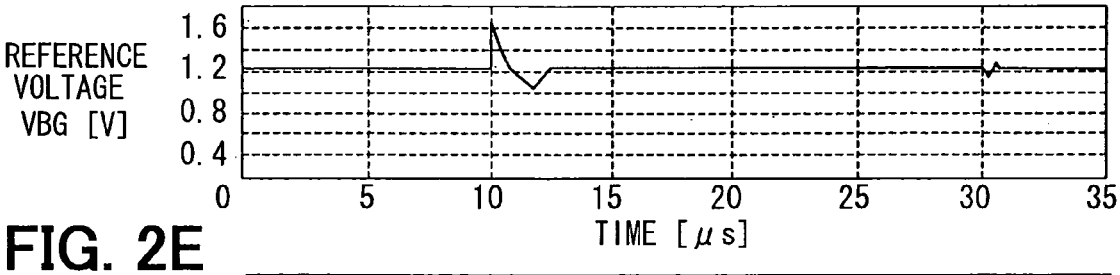
Figure 2E:
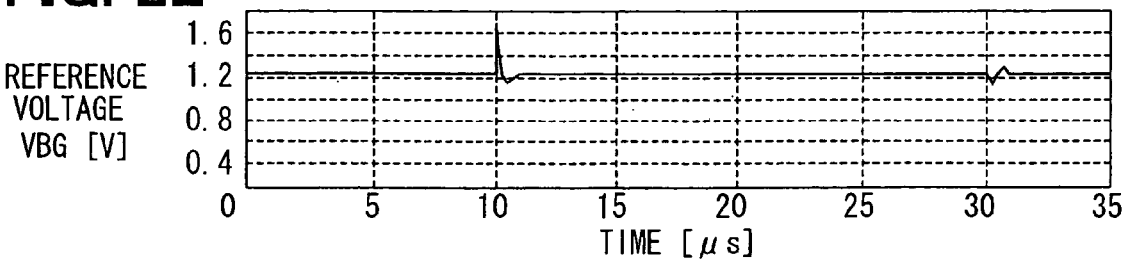

That is, FIG. 2B shows a case where the transistor Q22, the constant voltage circuit portion 23, the capacitor C11 and the transistor Q11 are not added (i.e., the power supply lines 15 and 22 are directly connected to each other), FIG. 2C shows a case where the transistor Q22 and the constant voltage circuit portion 23 are added, FIG. 2D shows a case where the transistor Q22, the constant voltage circuit portion 23 and the capacitor C11 are added, and FIG. 2E shows a case where the transistor Q22, the constant voltage circuit portion 23, the capacitor C11 and the transistor Q11 are added.

According to the simulation results, no sufficient voltage variation suppressing effect is achieved by merely adding the transistor Q22 and the constant voltage circuit portion 23. However, by adding the capacitor C11, the variation of the reference voltage VBG at the falling time of the power source voltage Vin is greatly suppressed, and further by adding the transistor Q11, the variation of the reference voltage VBG at the rise-up time of the power source voltage Vin can be greatly suppressed. That is, the voltage Vc of the power supply line 22 is made constant (fixed) by using the constant voltage circuit portion 23 and also both the capacitor C11 and the transistor Q11 are equipped, whereby the variation of the reference voltage VBG can be suppressed irrespective of the variation polarity of the power source voltage Vin. As described above, in order to generate the power source voltage Vc of the band-gap circuit 21, it is preferable to include all three constituent elements, that is, the constant voltage circuit portion 23, the capacitor C11 and the transistor Q11.

Next, the operation of the transistors Q12 and Q13 will be described.

With respect to these transistors Q12, Q13, like the transistor Q11, the amplitude of the voltage between the collector and emitter of each of the transistors Q20, Q21 is fixed to VBE, and the early effect of the transistors Q20, Q21 can be suppressed. Accordingly, the output current from the transistors Q12, Q13, that is, the bias current supplied from the power supply line 15 through the transistors Q20, Q12 and the current turn circuit 20 to the operational amplifier 25 of the band-gap circuit 21, and the operating current supplied from the power supply line 15 through the transistors Q21, Q13 to the reference voltage producing circuit 24 of the band-gap circuit 21 are made constant irrespective of the variation of the power source voltage Vin.

FIGS. 3A to 3D show results of simulations carried out to check the effect when the transistors Q12, Q13 are added. Specifically, FIGS. 3A to 3D show simulation waveforms of the reference voltage VBG when all the constant voltage circuit portion 23, the capacitor C11 and the transistor Q11 described above are equipped, and the following construction is adopted for each of the transistors Q12, Q13. The variation condition of the power source voltage Vin is the same as the condition used in the simulation shown in FIGS. 2A–2E (±140V/μs between 6V and 20V).

Figure 3A:
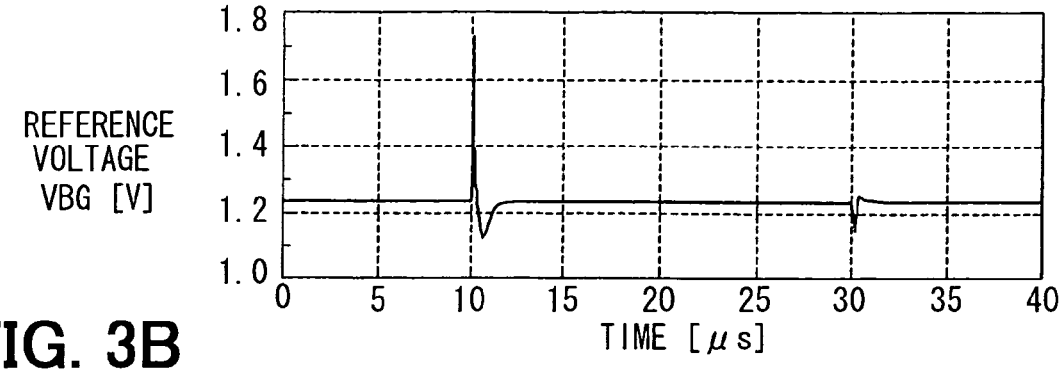
FIGS. 3A–3D are simulated voltage diagrams produced under different conditions.
Figure 3B:
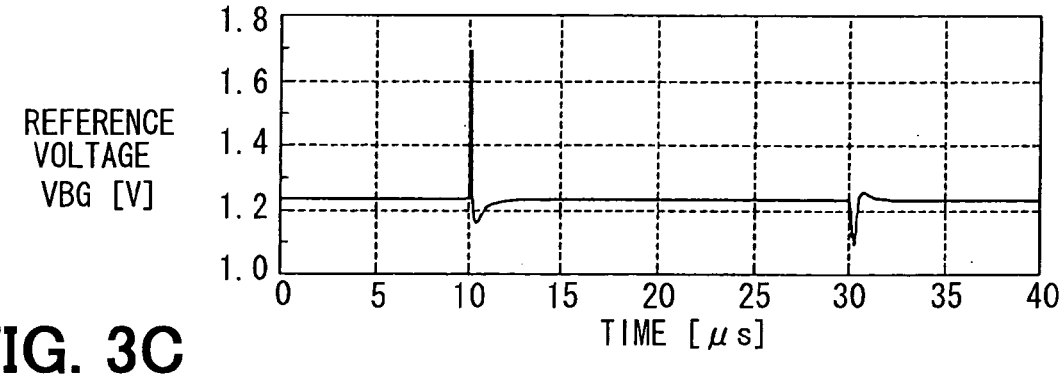
Figure 3C:
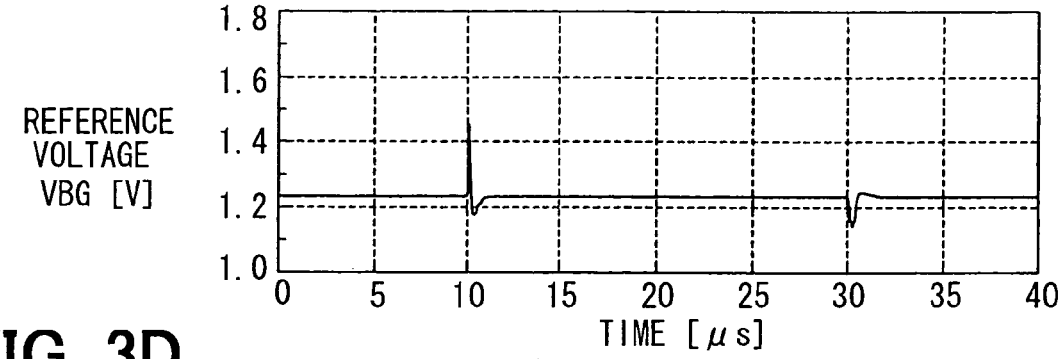
Figure 3D:
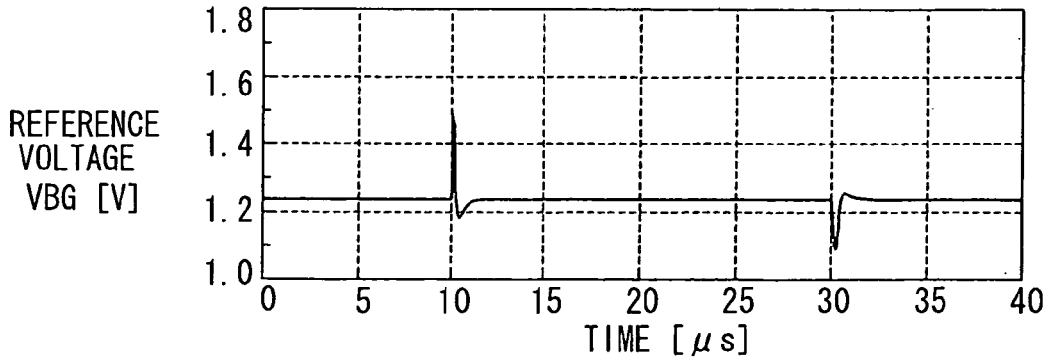

That is, FIG. 3A shows a case where neither the transistors Q12 nor Q13 are added, FIG. 3B shows a case where only the transistor Q12 is added, FIG. 3C shows a case where only the transistor Q13 is added, and FIG. 3D shows a case where both the transistors Q12 and Q13 are added.

According to the simulation result, it is apparent that the variation of the reference voltage VBG at the rise-up time of the power source voltage Vin can be greatly suppressed particularly by adding the transistor Q13. As compared with the cases shown in FIGS. 3C and 3D, a more excellent voltage variation suppressing effect can be achieved in the case where only the transistor Q13 is added, however, it is expected that there is a case where the transistor Q12 acts effectively under some conditions. As described above, the three constituent elements of the constant voltage circuit portion 23, the capacitor C11 and the transistor Q11 are quipped, and also the transistors Q12 and Q13 (particularly, Q13) are equipped, whereby the variation of the reference voltage VBG at the rise-up time of the power source voltage Vin which cannot be suppressed by adding only the constant voltage circuit portion 23, the capacitor C11 and the transistor Q11 can be surely suppressed.

As described above, the band-gap circuit 21 used in the reference voltage generating circuit 11 of this embodiment operates by using, not the power source voltage Vin, but the constant voltage Vc generated in the constant voltage circuit 19 as the power source voltage, and thus it hardly suffer variation of the power source voltage Vin. In order to further enhance the variation suppress effect of the reference voltage VBG, the constant voltage circuit portion 23 having the transistors Q23*a* to Q23G connected to one another in series and the capacitor C11 are equipped in the constant voltage circuit 19, and the transistor Q11 is equipped between the constant current circuit 18 and the constant voltage circuit 19.

When all the three circuit elements described above are added, the constant voltage Vc of the power supply line 22 is made constant (fixed to a constant voltage) by the constant voltage circuit portion 23, the variation of the reference voltage VBG at the falling time of the power source voltage vin is suppressed by the capacitor C11, and the variation of the reference voltage VBG at the rise-up time of the power source voltage Vin is suppressed by the transistor Q11. That is, the variation of the reference voltage VBG occurring due to the variation of the power source voltage Vin can be wholly suppressed irrespective of the variation polarity of the power source voltage Vin.

Furthermore, by adding the transistors Q12 and Q13 to prevent the early effect of the transistors Q20 and Q21 in the constant current circuit 18, the variation of the current supplied to the band-gap circuit 21 can be suppressed by the transistors Q20 and Q21. As a result, the variation of the reference voltage VBG at the rise-up time of the power source voltage Vin which still remains even when the above three circuits are added can be reduced.

As a result of the enhancement of the voltage variation suppressing effect as described above, the resistance values of the resistors R21, R22, R23 constituting the reference voltage producing circuit 24 can be increased to higher values than the prior art, so that the operating current of the reference voltage producing circuit 24, and thus the operating current (consumption current) of the reference voltage generating circuit 11 can be reduced. Furthermore, even when the consumption current of the IC for control is reduced as described above, it is not required to externally equip a capacitor for voltage stabilization between the terminals 14, 13, and thus both the substrate area when the control IC is mounted, and the cost can be reduced.

Figure 4:
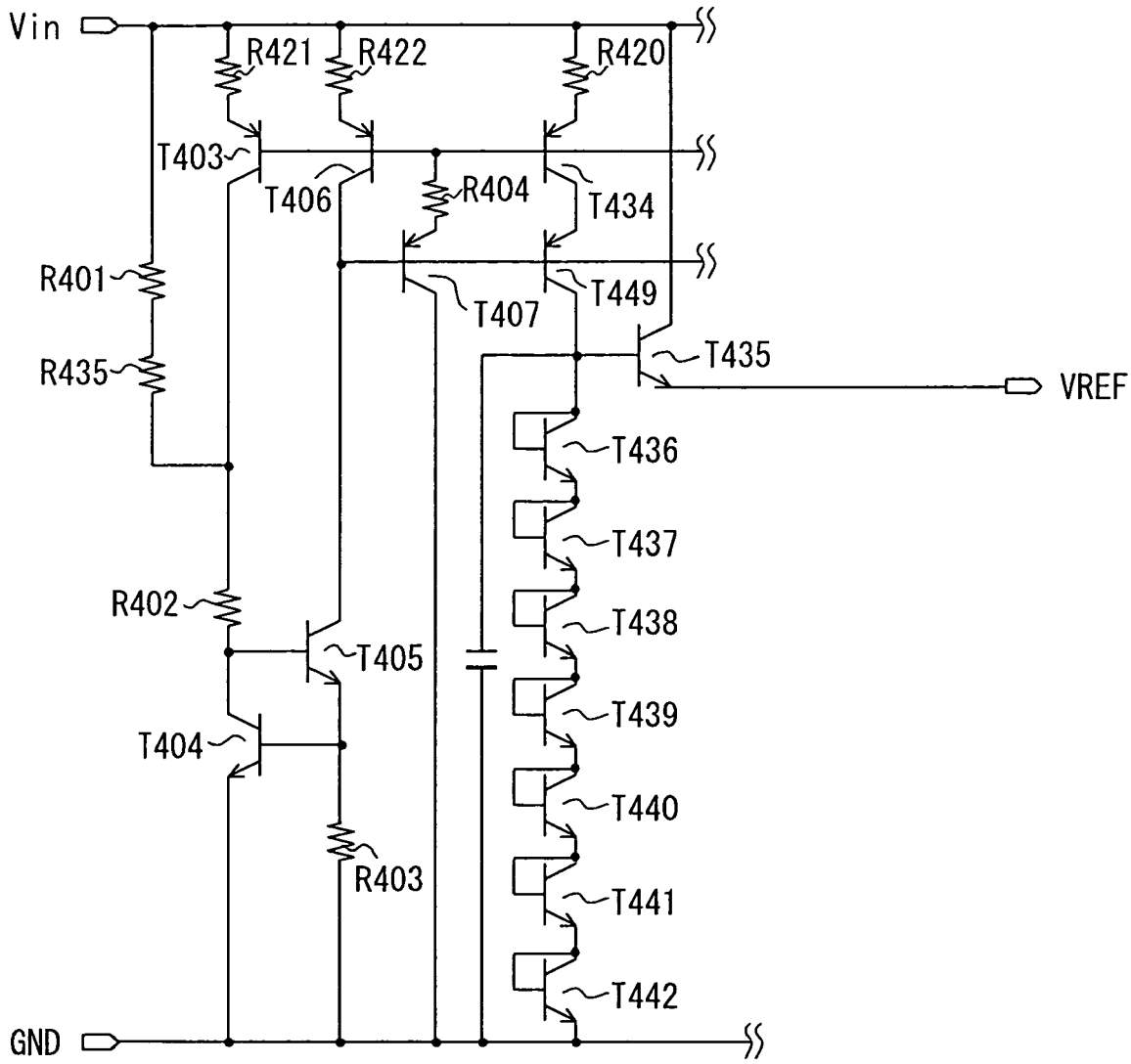
FIG. 4 is an electrical circuit diagram of a constant voltage generating circuit according to another preferred embodiment.
Figure 5:
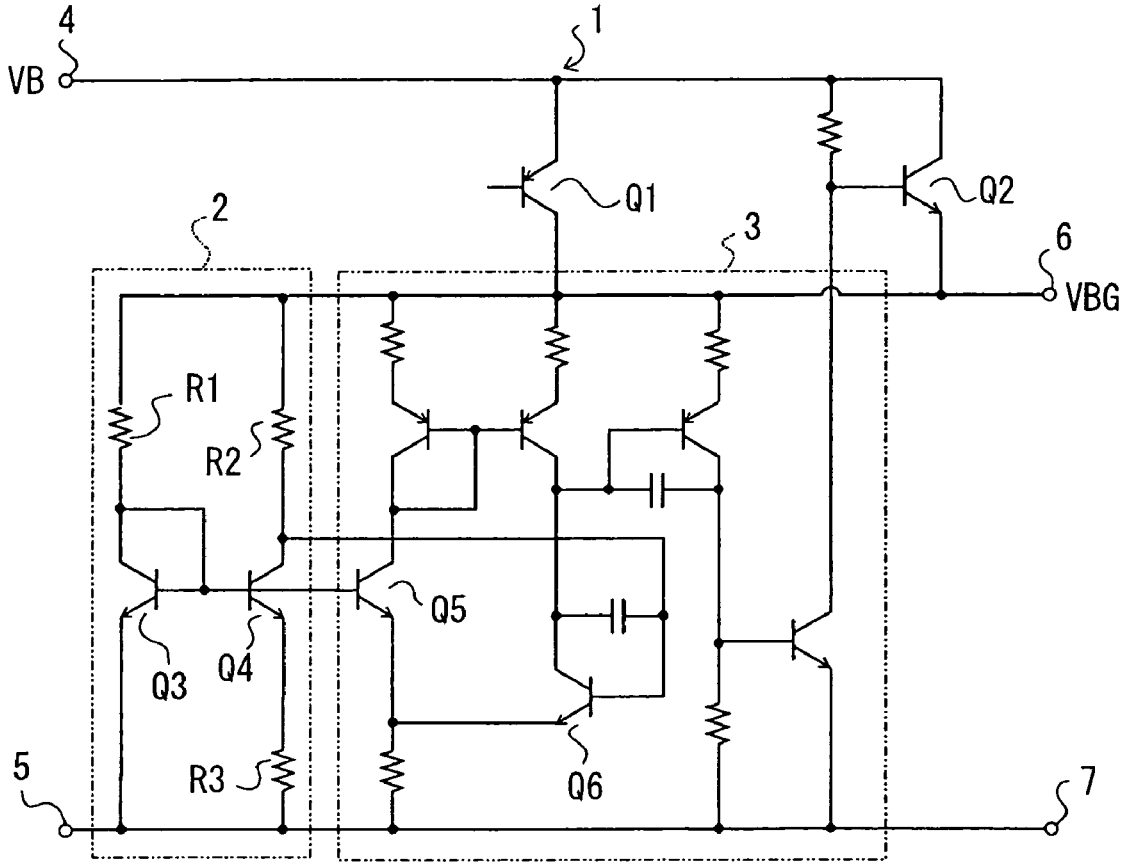
FIG. 5 PRIOR ART
FIG. 5 is an electrical circuit diagram of a prior art reference voltage generating circuit.

FIG. 4 is a diagram showing the electrical circuit construction of a constant voltage generating circuit according to another embodiment of the present invention. The electrical circuit construction shown in FIG. 4 corresponds to the electrical circuit construction shown in FIG. 1, and only the electrical circuit construction of the constant voltage generating circuit is shown in FIG. 4.

The present invention is not limited to the foregoing embodiments shown in the figures, and the following modification or expansion may be made.

Returning to FIG. 1, transistors Q12 and Q13 may be equipped only as needed. In this case, it is preferable that any one or both of the transistors Q12 and Q13 are equipped so that the highest voltage variation suppressing effect is achieved while checking the operation through simulations or tests. Also, a resistor may be equipped between the power supply line 22 and the emitter of each of the transistors Q26, Q28, Q36, Q38, Q40.

The reference voltage producing circuit 24 is not limited to that shown in FIG. 1. For example, it may be modified so that a first series circuit comprising a first resistor and a diode-connected fifth transistor, and a second series circuit comprising second and third resistors and a diode-connected sixth transistor are connected to each other in parallel between the reference voltage line 17 and the power supply line 16, the collector of the fifth transistor is connected to the resistor R24, and the common connection point between the second resistor and the third resistor is connected to the resistor R25.

Furthermore, in the above embodiments, the constant voltage circuit comprises plural diodes connected to one another in series. However, the same effect can be achieved by using zener diodes in place of the diodes.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A reference voltage generating circuit in which a power source voltage is input between an input power supply line and a ground line, and a band-gap reference voltage is output between a reference voltage line and the ground line, comprising:

a first transistor equipped between the input power supply line and a constant voltage power supply line;

a band-gap circuit for receiving voltage of the constant voltage power supply line and generating the band-gap reference voltage;

a constant voltage circuit comprising plural diodes connected to one another in series between a base of the first transistor and the ground line;

a capacitor connected between the base of the first transistor and the ground line;

a first constant current circuit for supplying constant current from the input power supply line to the constant voltage circuit; and a second transistor equipped between the first constant current circuit and the constant voltage circuit and operates upon input of a predetermined bias voltage to a base thereof.

2. The reference voltage generating circuit according to claim 1, further comprising:

a second constant current circuit for supplying constant current from the input power supply line to the reference voltage line; and a third transistor which is equipped between the second constant current circuit and the reference voltage line and operates upon input of a predetermined bias voltage to a base thereof.

3. The reference voltage generating circuit according to claim 2, further comprising:

a third constant current circuit for supplying bias current needed for the operation of the band-gap circuit from the input power supply line to the band-gap circuit; and a fourth transistor which is equipped between the third constant current circuit and the band-gap circuit and operates upon input of a predetermined bias voltage to the base thereof.

4. The reference voltage generating circuit according to claim 1, wherein the band-gap circuit comprises:

a reference voltage producing circuit comprising a first series circuit and a second series circuit, wherein the first series circuit is comprised of a first resistor and a fifth transistor, wherein the second series circuit is comprised of second and third resistors and a sixth transistor connected to each other in parallel, wherein the first and second transistors are driven with different current densities under a bias condition that a first reference voltage in the first series circuit and a second reference voltage in the second series circuit are equal to each other, wherein the differential voltage between base-emitter voltages of the first and second transistors is applied to the third resistor; and a differential amplifying circuit for receiving the first reference voltage and the second reference voltage, differentially amplifying the first and second reference voltages, and feeding back the output voltage thus differentially amplified through the reference voltage line to the reference voltage producing circuit.

5. The reference voltage generating circuit according to claim 4, wherein the band-gap circuit has a seventh transistor connected between the constant voltage power supply line and the reference voltage line, and the output voltage of the differential amplifying circuit is supplied to a base of the seventh transistor.

6. A constant voltage generating circuit in which a power source voltage is input between an input power supply line and a ground line and a constant voltage is generated between a constant voltage line and the ground line, comprising:

a first transistor equipped between the input power supply line and the constant voltage power supply line;

a constant voltage circuit comprising one or more diodes connected to one another in series between the base of the first transistor and the ground line;

a capacitor connected between the base of the first transistor and the ground line;

a constant current circuit for supplying constant current from the input power line to the constant voltage circuit; and a second transistor which is equipped between the constant current circuit and the constant voltage circuit and operates upon input of a predetermined bias voltage to a base thereof.

7. The constant voltage generating circuit according to claim 6, wherein the one or more diodes constituting the constant voltage circuit comprise zener diodes.

* * * * *